US005325647A

United States Patent [19]

Forry et al.

[11] Patent Number: 5,325,647

[45] Date of Patent: Jul. 5, 1994

[54] COMPOSITE CEILING GRID

[75] Inventors: John S. Forry; Chester W. Hallett, both of Lancaster, Pa.

[73] Assignee: Armstrong World Industries, Inc., Lancaster, Pa.

[21] Appl. No.: 933,093

[22] Filed: Aug. 21, 1992

[51] Int. Cl.[5] ..... F04B 9/06

[52] U.S. Cl. ..... 52/309.15; 52/309.16; 52/729; 52/732.1; 52/731.7; 52/506.07

[58] Field of Search ..... 52/484, 729, 732, 309.15, 52/309.16, 732.1, 731.7

[56] References Cited

U.S. PATENT DOCUMENTS

| | | | |
|---|---|---|---|
| 866,940 | 9/1907 | Lipman | 52/729 |
| 3,246,432 | 4/1966 | Young, Jr. | 52/484 |
| 3,355,206 | 11/1967 | Valsvik | 52/484 |
| 3,487,518 | 1/1970 | Hopfeld | 52/729 |
| 4,206,578 | 6/1980 | Mieyal | 52/484 |
| 4,932,186 | 6/1990 | John | 52/484 |

FOREIGN PATENT DOCUMENTS

| | | | |
|---|---|---|---|
| 650770 | 3/1962 | Canada | 52/729 |

*Primary Examiner*—Carl D. Friedman
*Assistant Examiner*—Christopher T. Kent

[57] ABSTRACT

The present invention relates to ceiling grid runners and associated assembly details that utilize metal reinforcement of thermoplastic compounds in order to obtain the necessary stiffness required to meet load/deflection standards for suspended ceiling systems. The metal is strategically positioned at the areas of highest stress, the top and bottom of the runner cross-section in what is analogous to the bulb and flange of traditional all metal grid.

7 Claims, 2 Drawing Sheets

COMPOSITE CEILING GRID

BACKGROUND OF THE INVENTION

1. Field of the Invention

This invention relates to ceiling grid runners and associated assembly details for suspended ceiling grid systems. More specifically the runners utilize a composite structure comprising an appropriately compounded thermoplastic polymer reinforced by strategically placed steel members. The product is corrosion free and upgraded visuals can be produced.

2. Description of the Prior Art

The I-beam principle for efficiently utilizing materials has been known for many years. A recent example is a wooden I-beam fabricated from reconstituted wood in such a way to maximize strength to weight ratio at the same time being able to use secondary quality wood that is unfit for use in more traditional wood construction products.

The traditional all metal suspended grid products use the I-beam principle to the greatest extent possible within the constraints of the existing manufacturing process. The entire profile of the grid must be all steel or some other metal. Therefore, the excellent tensile and compression strengths of steel are only partially employed in the regions closest to the neutral axis. Attempts have been made to increase material efficiency by adding loops of steel in the bulb and to otherwise increase the amount of steel farthest from the neutral axis. All these efforts still employ steel in regions where the bending tensile or compression stresses approach zero psi.

Products based on composite technology have long been known in the art. More recently much attention has been given the use of fibers of a variety of sorts such as fiberglass, carbon, aramid, and boron in the reinforcement of polymers and polymer blends. The result has been a class of products that provide the highest strength to weight ratios. Pultrusion is a specific process developed to produce composite products using low viscosity polymers, usually thermosets, and continuous fiber strands. The fibers are immersed in a liquid polymer tank and then pulled through a die to generate a desired profile, hence, the name pul (PULl) trusion (exTRUSION). The resin is then cured. The result is a product with high strength in the machine direction and an overall high strength to weight ratio. Such technology has been used to produce suspension grid runners. These products have the additional advantage of being corrosion free when compared to those using steel. However, the cost premium is quite high reaching into that incurred when either aluminum or stainless steel is used to achieve corrosion free performance within the metal family of materials.

SUMMARY OF THE INVENTION

Accordingly, it is an object of this invention to provide an economical corrosion free composite suspension ceiling grid runners through the use of steel embedded in a thermoplastic extruded profile in the regions of highest stress.

It is a further object of this invention to provide upgraded visual appeal to the flange of suspension grid by providing three dimensions to the flange area of the profile extrusion and employing shaping and detailing techniques that permit highly successful joining of grid sections so that the flange design appropriately flows around the corners of the grid openings.

It is still a further object of this invention to provide the ultimate in visual appeal by adding a variety of designs to the flange surface such as wood graining, marble, and random spattered colors. In the specific instance of wood graining, the result is nearly indistinguishable from actual wood.

A final object of this invention is to provide a process whereby the product can be practically manufactured. The two alternatives are cross-head extrusion and profile extrusion/fabrication by adhering the steel in appropriately designed cavities.

DESCRIPTION OF THE PREFERRED EMBODIMENTS

Figure 2:
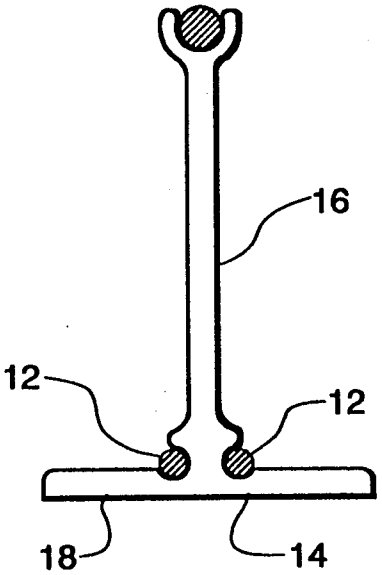
FIG. 2 is an end view of another embodiment of the invention.
Figure 1:
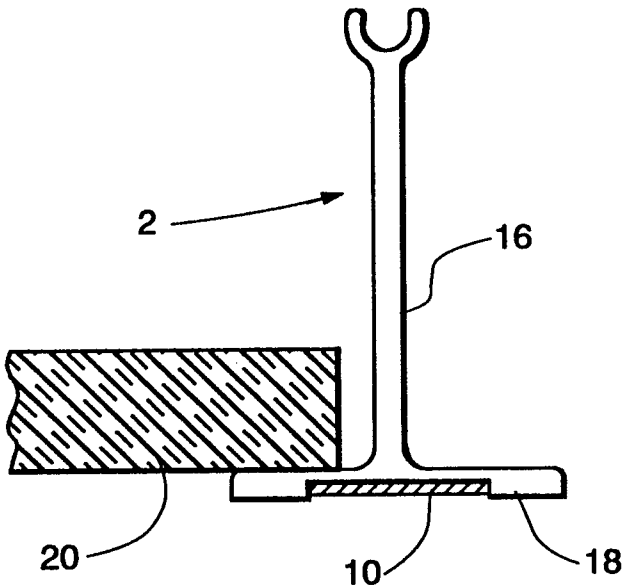
FIG. 1 is an end view of one embodiment of the invention.

The present invention relates to a suspended ceiling grid runner 2 comprising a rigid thermoplastic compound profile extruded to accommodate a steel wire 4 at the bulb 6 and another steel member 8, flat steel 10 or two wires 12, at the flange 14. The addition of the steel is accomplished by coating the contact surface of the profile or optionally coating the bonding surfaces of the steel with a suitable adhesive. The adhesive must be of sufficient modulus in order to satisfactorily resist the shear stresses at the metal/polymer interface and therefore prevent undesirable creep. Cleaning the surfaces will enhance the bonding strength. With proper design, the steel can be snapped into the receptacle to maintain its position while the adhesive bond develops. A wide range of adhesives have been found to be suitable. These include an epoxy, 2216 gray from 3M Company, and cyanoacrylates, Loctite 414 from Loctite Corporation and CA8 from 3M Company. The runner 2 is composed of a vertical section 16 and horizontal section 18. Horizontal section 18 can support a ceiling board 20 on either side of section 16.

Figure 4:
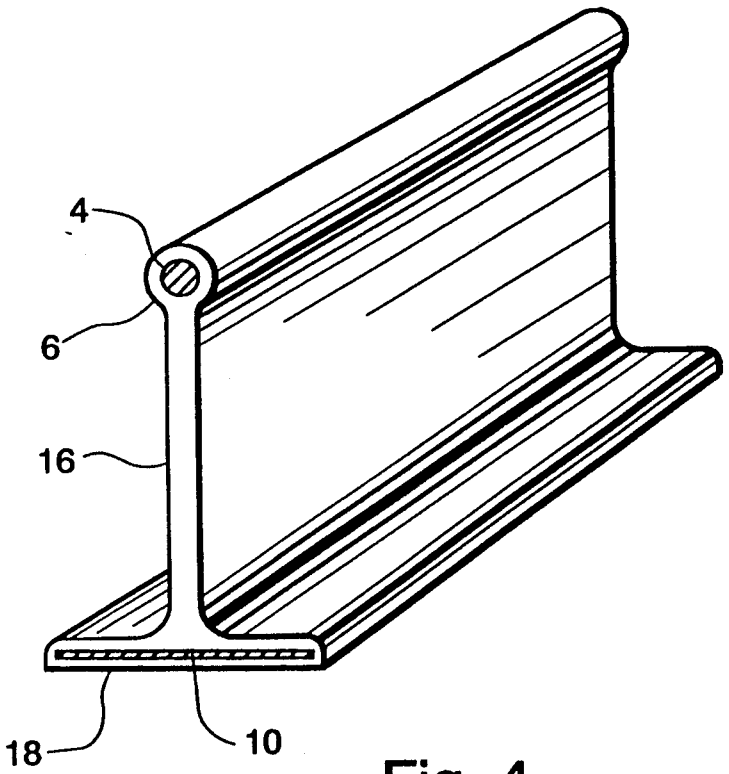
FIG. 4 is a perspective view of another embodiment of the invention.
Figure 3:
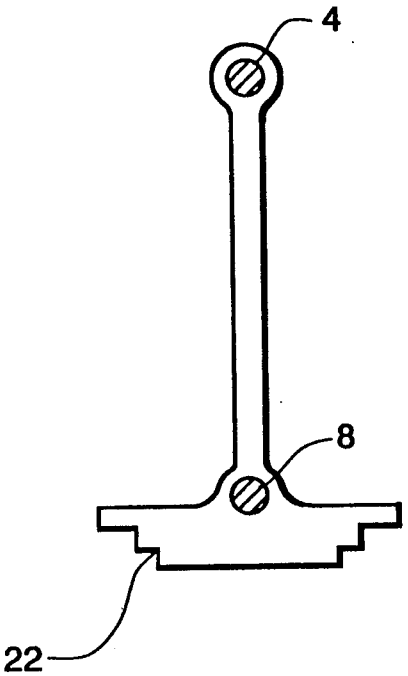
FIG. 3 is an end view of another embodiment of the invention.

In the preferred embodiment, the present invention relates to a suspended ceiling grid runner comprising a rigid thermoplastic compound cross-head extruded with two steel members, a steel wire embedded at the bulb and steel wire, FIG. 3, or flat steel, FIG. 4, embedded at the flange. With proper preparation of the steel surface involving such procedures as cleaning, toughening or knurling, or key coating, there is no need for use of a material to serve specifically as an adhesive. A rigid PVC compound is the preferred thermoplastic compound because of its economical costs and inherent flame retardancy. A talc filled rigid PVC such as TUFF-STIFF purchased from Georgia Gulf can also be used. This compound has the additional desirable characteristics of having a thermal coefficient of linear expansion closer to steel and having even more flame retardancy than unfilled PVC.

The steel/rigid PVC composite is cut to length, appropriate web details are punched out, and end detail means staked on to produce a completed product. The end detail means can join together two runners. The flange can then be further decorated by either metal foil stamping or a process to convert the plain color product into one with a variety of visuals ranging from wood grains to marbles or stone looks to random patterns of color.

The result is a most efficient material utilization as well as compensation for the undesirable creep properties of thermoplastics. The product is corrosion free. It is also lighter weight in a flat flange version comparable to all metal grid. The flange can be configured in a variety of three dimensional profiles, i.e. shape 22, FIG. 3, leading to a substantial visual enhancement. The surface can be decorated with a wide range of patterns such as a wood-grain to provide even further desirable visuals suitable for a variety of interior decors.

What is claimed is:

1. A support element with two ends comprising:

(a) a generally inverted T-shaped, elongated member having a horizontal section with a midpoint and a flat vertical section with two ends, said horizontal section having the first end of the vertical section joined thereto and extending therefrom at the midpoint thereof, the second end of the flat vertical section being an enlarged bulb shape;

(b) said T-shaped member being formed of a non-metallic material;

(c) said T-shaped member being reinforced at, at least, two selected spaced points with meal reinforcing elements terminating at the ends of the support element; and (d) said reinforcing elements being flat metal strips or wires embedded within the non-metallic material.

2. The element of claim 1 wherein:

(a) a reinforcing element is placed at the second end of the vertical section with the reinforcing member being in the bulb shape on the second end of the vertical section.

3. The element of claim 1 wherein:

(a) a reinforcing element is placed in a recess in the side of the horizontal section opposite from the side of the horizontal section adjoining the vertical section.

4. The element of claim 1 wherein:

(a) the vertical section has a recess on either side of the vertical section where the vertical section joins the horizontal section; and (b) the reinforcing element is in two pieces and each is placed in a recess.

5. The element of claim 1 wherein:

(a) one reinforcing element is embedded in the bulb shape; and (b) the second reinforcing element is embedded in the junction of the vertical section and horizontal section.

6. The element of claim 1 wherein:

(a) the reinforcing element is at least two pieces, one placed near the end of the vertical section spaced from the end of the vertical section adjacent the horizontal section and the second placed in or by the horizontal section.

7. The element of claim 1 wherein: '(a) the side of the horizontal section opposite from the side of the horizontal section adjoining the vertical section having a multi-level, three dimensional configuration.

* * * * *